US010138015B2

(12) United States Patent
Deckert et al.

(10) Patent No.: US 10,138,015 B2
(45) Date of Patent: Nov. 27, 2018

(54) METHOD FOR CONTROLLING A LABELING MACHINE, LABELING UNIT AND CONTAINER HANDLING SYSTEM

(71) Applicant: KHS GmbH, Dortmund (DE)

(72) Inventors: Lutz Deckert, Haltern am See (DE); Klaus Krämer, Dortmund (DE)

(73) Assignee: KHS GmbH, Dortmund (DE)

( * ) Notice: Subject to any disclaimer, the term of this patent is extended or adjusted under 35 U.S.C. 154(b) by 157 days.

(21) Appl. No.: 15/039,109

(22) PCT Filed: Oct. 22, 2014

(86) PCT No.: PCT/EP2014/072597

§ 371 (c)(1),
(2) Date: May 25, 2016

(87) PCT Pub. No.: WO2015/074820

PCT Pub. Date: May 28, 2015

(65) Prior Publication Data

US 2017/0210502 A1 Jul. 27, 2017

(30) Foreign Application Priority Data

Nov. 25, 2013 (DE) ..... 10 2013 112 992

(51) Int. Cl.

| | |
|---|---|
| ***B65C 9/42*** | (2006.01) |
| ***B65C 9/40*** | (2006.01) |
| ***B65C 3/26*** | (2006.01) |
| ***B65C 9/04*** | (2006.01) |
| ***B65C 9/18*** | (2006.01) |
| *B65C 9/00* | (2006.01) |

(52) U.S. Cl.

CPC ..... *B65C 9/42* (2013.01); *B65C 3/26* (2013.01); *B65C 9/04* (2013.01); *B65C 9/18* (2013.01); *B65C 9/40* (2013.01); *B65C 2009/0081* (2013.01)

(58) Field of Classification Search

CPC .... B65C 3/26; B65C 9/04; B65C 9/18; B65C 9/40; B65C 9/42; B65C 2009/404; B65C 2009/407; B29C 2009/404; B29C 2009/407

USPC ..... 156/64

See application file for complete search history.

(56) References Cited

U.S. PATENT DOCUMENTS

| | | | |
|---|---|---|---|
| 4,735,664 A | 4/1988 | Asghar et al. | |
| 2007/0017593 A1 | 1/2007 | Bernhard | |
| 2009/0126866 A1 * | 5/2009 | Stenner | B65C 9/1869 156/235 |

(Continued)

FOREIGN PATENT DOCUMENTS

| | | |
|---|---|---|
| DE | 4311129 | 10/1994 |
| DE | 102009040346 | 3/2011 |

(Continued)

*Primary Examiner* — George R Koch
(74) *Attorney, Agent, or Firm* — Occhiuti & Rohlicek LLP

(57) ABSTRACT

A process for using a first labeling system that is a constituent of a block-form first container-handling includes, before switching between said labeling and non-labeling modes of a labeling unit thereof, providing a control signal to a control unit that controls the labeling machine, the control signal being indicative of a gap in container flow. the control signal occurs before the gap in container flow reaches a container inlet of the first labeling system.

19 Claims, 7 Drawing Sheets

(56) References Cited

U.S. PATENT DOCUMENTS

| | | | | |
|---|---|---|---|---|
| 2011/0056610 | A1* | 3/2011 | Koller | B65C 9/40<br>156/64 |
| 2014/0041807 | A1* | 2/2014 | Schinelli | B65C 9/42<br>156/363 |

FOREIGN PATENT DOCUMENTS

| | | |
|---|---|---|
| EP | 2 295 326 | 3/2011 |
| WO | WO 2003/068606 | 8/2003 |
| WO | WO 2007/124821 | 11/2007 |
| WO | WO 2011/001216 | 1/2011 |
| WO | WO 2012/146501 | 11/2012 |

* cited by examiner

METHOD FOR CONTROLLING A LABELING MACHINE, LABELING UNIT AND CONTAINER HANDLING SYSTEM

RELATED APPLICATIONS

This application is the national stage, under 35 USC 371, of PCT international application PCT/EP2014/072597, filed on Oct. 22, 2014, which claims the benefit of the Nov. 25, 2013 priority date of German application DE 102013112992.7.

FIELD OF INVENTION

The invention relates to container processing, and in particular, to labeling containers.

BACKGROUND

The principle is usual and well-known of operating labeling machines with an uninterrupted flow of containers incoming at a container inlet of these machines in order to achieve a continuously running labeling process. This continuous labeling process is achieved, in part, by providing controllable buffer and storage stretches arranged in the transport direction upstream of the labeling machine, and by controlling the operating speed or capacity of the labeling machine. Due to the buffer and storage stretches, gaps in the flow of containers conducted to the labeling machine can be avoided in the event of a further container handling machine upstream of the labeling machine causing such gaps, due, for example, to malfunction.

In this situation, it is important for changes in the operating speed of the labeling machine to take place in such a way that all the components involved in this machine, and in particular also the labeling unit, can follow the changes and the operating speed respectively of the labeling machine without mechanical failure of these components and/or without tearing, fluttering, knocking, extension etc. occurring of a label strip being used. Particular attention must be paid to such components at changes of the operating speed of the labeling machines, which exhibit a high mechanical and/or dynamic moment of inertia, such as label strip rolls from which the processed label strip is drawn off.

The principle is further known of configuring labeling machines in such a way that they themselves react to gaps in the incoming flow of containers, for example, by sensors provided at the container inlet, and, in the event of a container being missing at a labeling position, that they stop the preparation and/or handover of the label.

It is also usual for labeling units for the processing of label strips to be equipped with label strips with label strip stores or short "strip stores," which in the short term provide the possibility of compensating for surplus or missing label material. The setting of a dancer roller, which comprises at least one strip deflection, then controls drives of the labeling unit to draw off the label strip from the label strip store or label strip roll and to provide the labels at the labeling position.

Particular problems arise, however, if it is intended that a labeling machine should be used in a container handling system in block form together with a further container handling machine, such as a stretch blow-molding machine, for producing the containers by stretch blow-molding, i.e. together with a container handling machine that does not allow for continuous regulation of its capacity, but that does allow for a stepped change in this capacity.

"Block form," in this context, means that the containers are transported in an exact cycle from the further container-handling machine, such as a stretch blow-molding machine, via a transport stretch to the container inlet of the labeling machine, i.e. in a container flow in which the containers exhibit a division spacing interval between one another, which is specifically determined by the cycle of the further container handling machine and by container retainers of the container-transport stretch.

Such a container handling system in block form does indeed have the advantage that the containers can be held securely, for example suspended from a flange or neck ring formed beneath the container aperture, and transported securely to the labeling machine, and, due to the absence of buffer and storage stretches, in which the containers are arranged, for example, standing upright with their container bases on transport belts, the structural volume of the system can be reduced, and gaps due to containers falling over are avoided.

Nevertheless, in particular at high capacity outputs, as defined by the number of containers prepared and labeled per time unit, gaps in the container flow cause substantial problems. This is attributable in particular to the fact that, for example at capacities of 60,000 to 70,000 containers per hour, gaps occurring in the container flow cannot be reacted to with conventional labeling machines and their control systems, and in particular due to the fact that the time available is not sufficient for a necessary change in the operational mode of the labeling machine (stopping and starting of this machine at the beginning and end of a gap), as well as the necessary reduction or running up again of the speed of components of the labeling unit.

SUMMARY

An object of the invention is to eliminate this disadvantage and to present a method with which the controlling of a labeling machine in a block-type container handling machine is possible, in particular even at high capacity output and in the event of gaps occurring in the container flow.

A container handling system in "block" form means, in the sense of the invention, that the containers are transported to the container application element machine or labeling machine with a division spacing interval, which is determined by the operational cycle of a further machine upstream and by the division spacing interval of container retainers on container transport elements or transport star elements, which form a container-transport stretch between the further machine and the container application element machine or labeling machine, wherein the division spacing interval of the container handling machine can also diverge entirely from the division spacing interval of the further machine (division delay).

"Containers" in the meaning of the invention are in particular cans, bottles, in each case made of metal, glass, or preferably from plastic.

"Application features" in the meaning of the invention are elements that are applied onto the containers as information and/or publicity elements or instructions and/or for the provision of proof of guarantee and/or originality and/or for the creation of a visual appearance of the container being striven for. Application elements in this sense are in particular labels, banderols, films, but also printed images applied onto the containers, etc.

"Application elements" in the meaning of the invention are labels, but also banderols, films, etc. The application of these elements is carried out with machines, which are designated in general as labeling machines.

The expressions "essentially" or "some" or "approx." signify in the meaning of the invention deviations from the exact value in each case by +/−10%, preferably by +/−5%, and/or deviations in the form of changes which are not significant for the function.

Further embodiments, advantages, and possible applications of the invention also derive from the following description of embodiments and from the figures. In this context, all the features described and/or figuratively represented are in principle objects of the invention, either alone or in any desired combination, regardless of their inclusion in the claims or reference to them. The contents of the claims are also to be considered as constituent parts of the description.

The invention is explained in greater detail hereinafter on the basis of the figures and in relation to an exemplary embodiment. The figures show:

DETAILED DESCRIPTION

Figure 1:
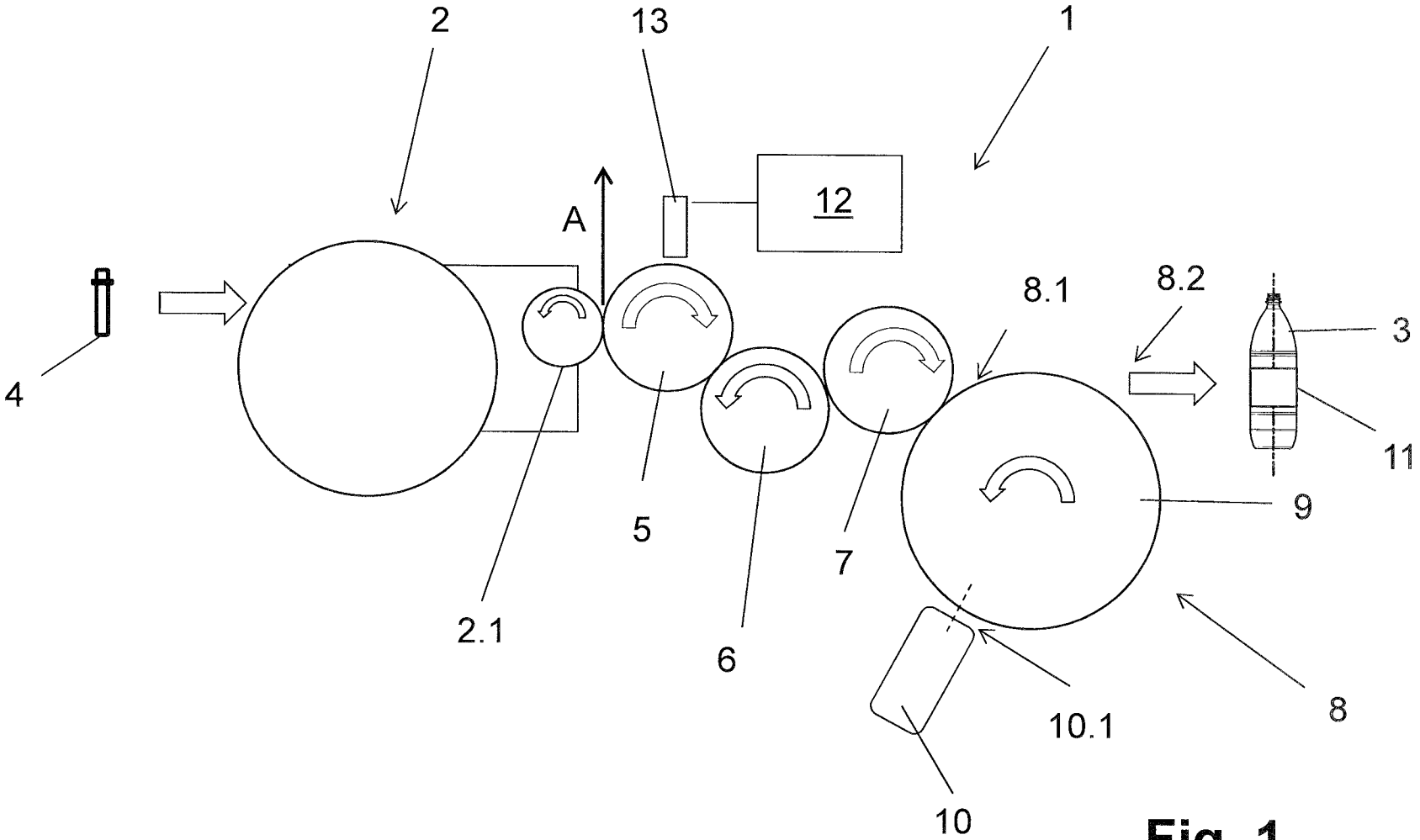
FIG. 1 shows a container-handling system in block form, with a stretch blow-molding machine, for producing containers, and with a labeling machine of the circulating type for applying application elements in the form of labels onto containers with the use of a strip-shaped equipment or label material.

FIG. 1 shows a system 1 comprising, among other elements, a stretch blow-molding machine 2 for producing containers 3 from preforms 4. These containers are typically plastic bottles, such as PET bottles.

The system 1 also includes first, second, and third transport elements 5, 6, 7 leading away from an outlet of the stretch blow-molding machine 2. first, second, and third transport elements 5, 6, 7 are typically transport stars, each of which can be driven about its vertical axis. Each transport star 5, 6, 7 includes, along a circumference thereof, container retainers spaced apart from each other at some division spacing interval. These container retainers suspend the containers 3 as they are transported to a container inlet 8.1 of a labeling system 8.

The labeling system 8 has a labeling-machine rotor 9 capable of being driven so as to rotate about a vertical machine axis thereof. Container retainers formed on the rotor's circumference are separated from each other at a specified division spacing interval.

The container retainers formed on the labeling-machine rotor 9 receive containers passed over individually from the third transport element 7. The container retainers then move the containers 3 past a labeling machine 10 or past a labeling position 10.1 for the application of the labels 11. Neither the labeling machine 10 nor the labeling position 10.1 rotate with the labeling-machine rotor 9. The labeled containers 3 are taken from the labeling-machine rotor 9 at a container outlet 8.2 and conducted to a further use.

The transport elements 5-7 can be constituents, such as rotors, of a rotating container-handling machine. For example the second transport element 6 can be a rotor of a filling machine for filling containers 3. Or, the third transport element 7 can be a rotor of a closing machine that closes the filled containers 3.

The illustrated system 1 is a block form system. In such a system, the containers 3 produced by the stretch blow-molding machine 2 are provided at an outlet 2.1 thereof at a rate that matches the operating cycle of the stretch blow-molding machine 2. The rate at which the stretch blow-molding machine 2 provides containers 3 can either not be regulated or regulated only to a very limited extent in steps.

The first, second, and third transport elements 5, 6, 7 then convey the containers 3, at the same rate, to the labeling system 8 or, to the container retainers located at the labeling-machine rotor 9. This occurs without the intermediate engagement of buffer and/or storage stretches, and at a predetermined spacing interval, which is determined by the spacing interval of the container retainers of the first, second, and third transport elements 5, 6, 7.

Figure 2:
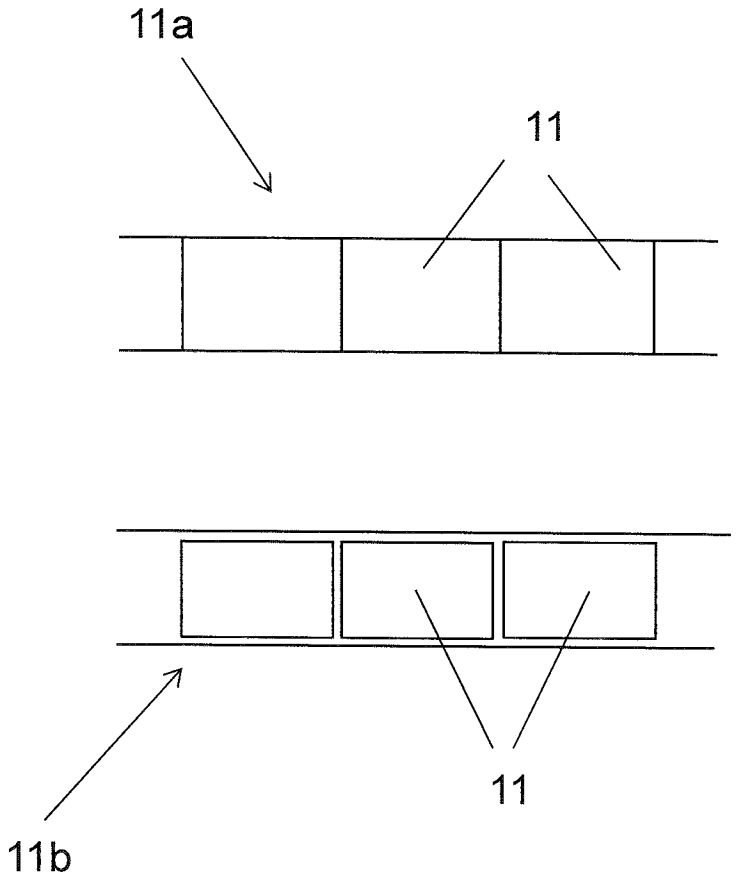
FIG. 2 shows a portion of a strip-shaped label material, or label strip, for use with the system from FIG. 1.

As shown in FIG. 2, the labeling machine 10 is configured for processing a strip-form label material or label strip 11*a*, 11*b* from which the labels 11 are provided either by separation or as self-adhesive labels by drawing off from a carrier strip.

The configuration of the system 1 in block form has substantial advantages. For example, the containers 3 can be transported, during the transport to the labeling system 8 in an especially reliable manner, i.e. for example retained on a neck ring formed beneath the container aperture. In addition, it is possible to avoid having a buffer and/or storage stretch. This avoids a higher investment volume and also a greater spatial requirement, and also avoids having transport belts on which the containers would stand on their bases, thereby incurring the risk of faults due to containers toppling over.

Due to the block form of the system 1, and due to the fact that the output from the stretch blow-molding machine can be operated not continuously but in all situations in steps of a fixed capacity in each case, the problem does however arise that the labeling system 8, and in particular also its labeling machine 10, at high output from the stretch blow-molding machine 2, for example of 70,000 containers per hour, must be able to speed up in fractions of a second from an initial state to, for example, an operating speed that corresponds to the maximum capacity of the stretch blow-molding machine, or switch off.

Due to the block arrangement, it is also necessary for the labeling system 8, or its labeling machine 10 respectively, likewise to react without any delay to gaps in the container flow being conveyed, incurred, for example, due to an interruption in the operation of the stretch blow-molding machine 2 and/or by the screening out of defective containers 3 at the outlet of the stretch blow-molding machine 2 (arrow A).

This means that only when a container 3 has in fact reached the labeling position 10.1 with the labeling-machine rotor 9 that a label is transferred onto the respective container 3, and that the transfer or provision of the labels 11 for the transfer is interrupted, without any delay, if one or more gaps in the containers, i.e. container retainers not occupied by a container 3, pass the labeling position 10.1. It is further necessary that, at the labeling machine 10, the provision of labels 11 for the transfer to containers 3 is immediately interrupted when, at the end of a production run or of a labeling process, the last container 3 has passed the labeling position 10.1

It is understood that, during the operation of the first, second, and third transport elements 5, 6, 7, the labeling-machine rotor 9 is also driven in synchrony with the stretch blow-molding machine 2, and that thereby only the labeling machine 10 is controlled in accordance with the operating states of the system 1.

A sensor device 13 assists in controlling the labeling machine 10. The sensor device 13 interacts with a control electronics unit 12, which can be a system control unit or part of a system control unit. In particular, the sensor device 13 detects the number, division distribution, and/or temporal sequence of the containers 3 transported to the labeling system 8 and provides such information to the control electronics unit 12. Based on such information, the control electronics 12 issues a temporally pre-emptive information and control signal S to effect control over the labeling machine 10.

In contrast with known systems, the sensor device 13 is not located at the container inlet of the labeling system 8. It is located on a container-transport stretch that preferably has a retention capacity of at least ten containers, if not twenty or thirty. Therefore, the sensor device 13 does not detect the number, division distribution, and temporal sequence of the containers directly at the container inlet 8.1 of the labeling system 8. Instead, the sensor device 13 is provided for, in relation to the transport direction of the containers 3, at an adequate distance from the container inlet 8.1. In the illustrated embodiment, the sensor device 13 is at the first transport element 5 at or in the vicinity of the outlet of the stretch blow-molding machine 2.

If the sensor device 13 had been provided at the container inlet 8.1 of the labeling machine 8, and if the stretch blow-molding machine 2 were to then be driven its capacity, which is on the order of 70,000 containers per hour, there would still remain, with an arrangement of the sensor device 13 at the labeling machine, for the switching the labeling unit between a labeling mode and a non-labeling mode, a control or run-up time tv of approximately 1/20 second. When taking account the inertia of the various components of the labeling device 10 that are to be controlled, this run-up time is insufficient.

Due to the arrangement of the sensor device 13 at a container-transport stretch spaced at a distance upstream of the container inlet 8.1 of the labeling system 8, there are a number n of container retainers between the sensor device 13 and the container inlet 8.1 that are occupied by containers 3 or do not hold any containers 3. The run-up time tv is increased by an amount that depends on n. For example, with a retention capacity of 20 to 30 container retainers, the run-up time tv increases by 1 to 1.5 seconds.

Due to the extended run-up time tv, even when the stretch blow-molding machine 2 runs at high output capacity, it is still possible to reliably transition between the labeling and non-labeling operating states of the labeling unit is possible. The system 1, the labeling system 8, and its labeling machine 10 are under pre-control, and do not react to the sensor signal of an individual sensor provided on the labeling machine. The temporally pre-emptive information and control signal S can also be provided by the stretch blow-molding machine 2.

Figure 3:
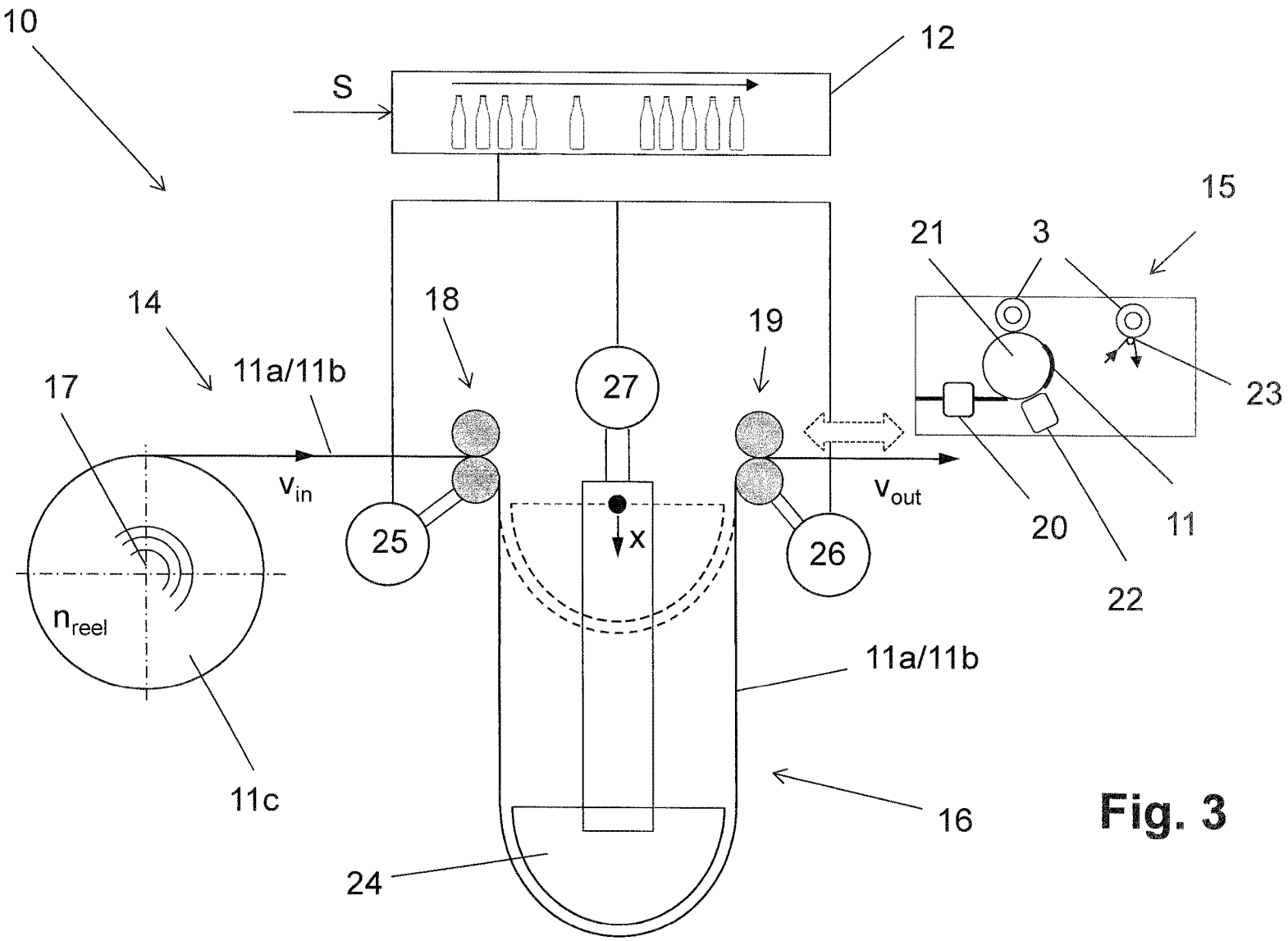
FIG. 3 shows a labeling unit of the labeling machine from the system from FIG. 1.

Referring now to FIG. 3, the labeling machine 10 includes a label feed 14, a labeling unit 15, and an active label-strip store 16 arranged between the label feed 14 and the labeling unit 15 for storing a stock of label strips.

The label feed 14 comprises a mandrel or retainer 17 as well as a first label draw-off device 18. The retainer 17 retains a store roll formed from a label strip 11*a*, 11*b*, or a label-strip roll 11*c*. The first label draw-off device 18 includes two rolls or rollers for drawing off the label strip 11*a*, 11*b* from the label-strip roll 11*c* and for feeding the label strip into the strip store 16.

As shown on the opposite side of FIG. 3, the labeling unit 15 comprises a second label draw-off device 19, a cutting device 20, a transfer cylinder 21, a gluing device 22, and a dispensing edge 23. The second label draw-off device 19 includes two rolls or rollers, for drawing off the label strip 11*a*, 11*b* from the strip store 16 and for providing the label strip for the transfer of the labels 11 to containers 3. The cutting device 20 separates the label 11. The transfer cylinder 21, which is driven so as to rotate about a vertical axis, transfers the separated label 11 to the gluing device 22, for application of glue, and on to a container 3 waiting at the labeling position 10.1. When the labels are self-adhesive, they are drawn over the dispensing edge 23 in order to detach the self-adhesive labels 11.

The middle of FIG. 3 shows the strip store 16. The strip store 16 includes label strip deflectors or label strip deflection rollers. These are arranged partly at a fixed location and partly on a moving dancer roller or carriage 24. The deflectors and the rollers cooperate to guide the label strip 11*a*, 11*b* and to form at least one loop having a variable length. To simplify FIG. 3's representation of the strip store 16, only the dancer roller or carriage 24 is shown as controlling label strip deflection.

A particular feature of the labeling machine 10 lies in the fact that, for the label strip feed 14, i.e. for the drive of the components located there, in particular the retainer 17 and the first label draw-off device 18, but also for other driving components, not shown in FIG. 3, of the label strip feed 14, a first drive 25 is provided, in the form of at least one electric motor, for the labeling unit 15 and its driving components, in particular for the second label draw-off device 19, the cutting device 20, the transfer cylinder 21, as well as, for other driving components of the labeling unit 15, a second drive 26 in the form of at least one electric motor, and, for the controlled movement of the dancer roller or carriage 24, a third drive 27, preferably in the form of a controllable electric linear drive, wherein the third drive 27 is preferably a power or load-controlled or regulated drive, which avoids an over-extension of the label strip 11*a*, 11*b* respectively. In this situation it is also possible for the mass inertia of the dancer roller or carriage 24 to be compensated and the dynamic forces not to be applied by way of the label strip 11*a*, 11*b*.

The drives of the label strip feed 14, of the labeling unit 15, and of the strip store 16 can be controlled individually by the control electronics 12 as a function of the sensor signal provided by the sensor unit 13. The first and second label draw-off devices 18, 19 can also be allocated to the strip store 16. In such a case, the first label draw-off device 18 functions as a label strip inlet and the second label draw-off device 19 functions as a label strip outlet. In a typical embodiment, a maximum occupation level x of the strip store 16 corresponds to 1500 mm length of the label strip 11*a*, 11*b* being stored in the strip store 16.

Figure 5:
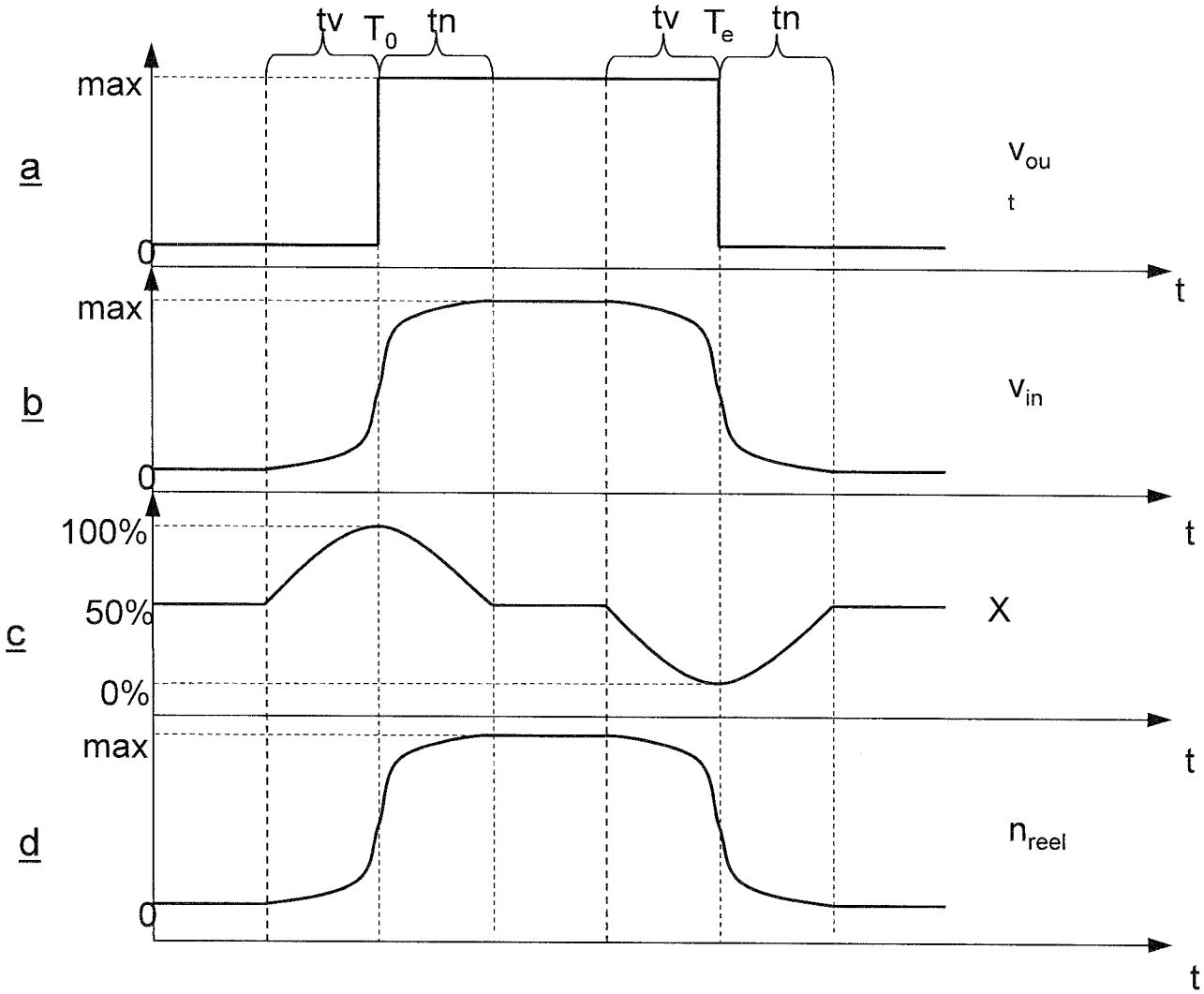
FIGS. 5-7 show the temporal sequence of operational states of different components of the labeling unit in different operational states.

Graphs a-d of FIG. 5 show the temporal sequence of the operational state of different components of the labeling system 8 at the beginning and end of a labeling process, wherein it is assumed that the labeling machine 10 is in a start position before the beginning of the labeling process, in which the strip store, due to the corresponding position of the dancer roller or carriage 24, is only partly filled with the label strip 11*a*, 11*b*, occupied for example with only 50% of its maximum storage capacity. At the end of the labeling process, the labeling machine 10 once again adopts this start position. Moreover, in this start position, at least immediately before the beginning of the labeling process, the required strip tension pertains in the label store 16, and the voltages and/or control information is present at the first, second, and third drives 25, 26, 27.

Graph a of FIG. 5 shows the temporal sequence of the speed Vout, at which the label strip 11*a*, 11*b* is drawn from the strip store 16, wherein this speed Vout at the same time corresponds to the number of the labels 11 transferred to containers 3 per time unit. As shown, the speed Vout increases at the beginning of the labeling process, i.e. at the point of time T0, without any delay from zero to the maximum speed Vout determined by the performance capacity of the stretch blow-molding machine 2, which, if operation is free of any disruption, is maintained until the end of production. At the end of the labeling process, as soon as the last container 3 of the container flow has passed the labeling position 10.1, the speed Vout is reduced to zero without any delay.

Graph b of FIG. 5 shows the temporal sequence of the speed Vin at which the label strip 11*a*, 11*b* is drawn off the label-strip roll 11*c* and fed to the strip store 16. As shown, the run-up time tv preceding the point of time T0 is used for the purpose of activating, before the transfer of the first label 11, the first drive 25, speeding up the components of the label strip feed 14, and in this situation, in particular, also speeding up the label-strip roll 11*c*, as well as thereby additionally filling the store, corresponding to the temporal sequence of graph c, which reproduces the occupation level x of this strip store. It is only after a follow-on time, following the point of time T0, that the speed Vin reaches its maximum value, which corresponds to the maximum value Vout. The label strip 11*a*, 11*b* which is required is drawn from the strip store 16 during the follow-on time tn, which has, for example, assumed its maximum occupation level x (degree of filling) at the point of time T0. After the expiry of the follow-on time tn, the strip store 16 has regained its occupation level or its initially part-filled state respectively.

Before the ending of the labeling process, at the point of time Te, during the run-up time tv which precedes this point of time a reduction takes place of the speed Vin, wherein, during this run-up time, the label strip 11*a*, 11*b* which is required is drawn out of the strip store 16, and the occupation level x of this store is reduced. After the point of time Te, in a follow-on time tn, a further reduction takes place of the speed Vin to zero, and specifically with a corresponding increase in the occupation level of the strip store 16.

Graph d of FIG. 5 shows the temporal sequence of the speed of rotation nreel of the retainer 17, which corresponds to the speed Vin, wherein, however, the actual present amplitude of the speed of rotation nreel depends on the diameter of the label-strip roll 11*c*.

The run-up time tn, as well as the times T0 and Te are determined by the control electronics 12 on the basis of the signal from the sensor unit 13. The follow-on time tn is, for example, a value deposited in the control electronics 12, which takes account of the mechanical parameters (in particular the moment of inertia) of the label strip feed 14. The temporal change in the occupation level of the strip store 16 is actively controlled or regulated, for example, as a function of the run-up time tv, the follow-on time tn, and the speed Vout.

Figure 6:
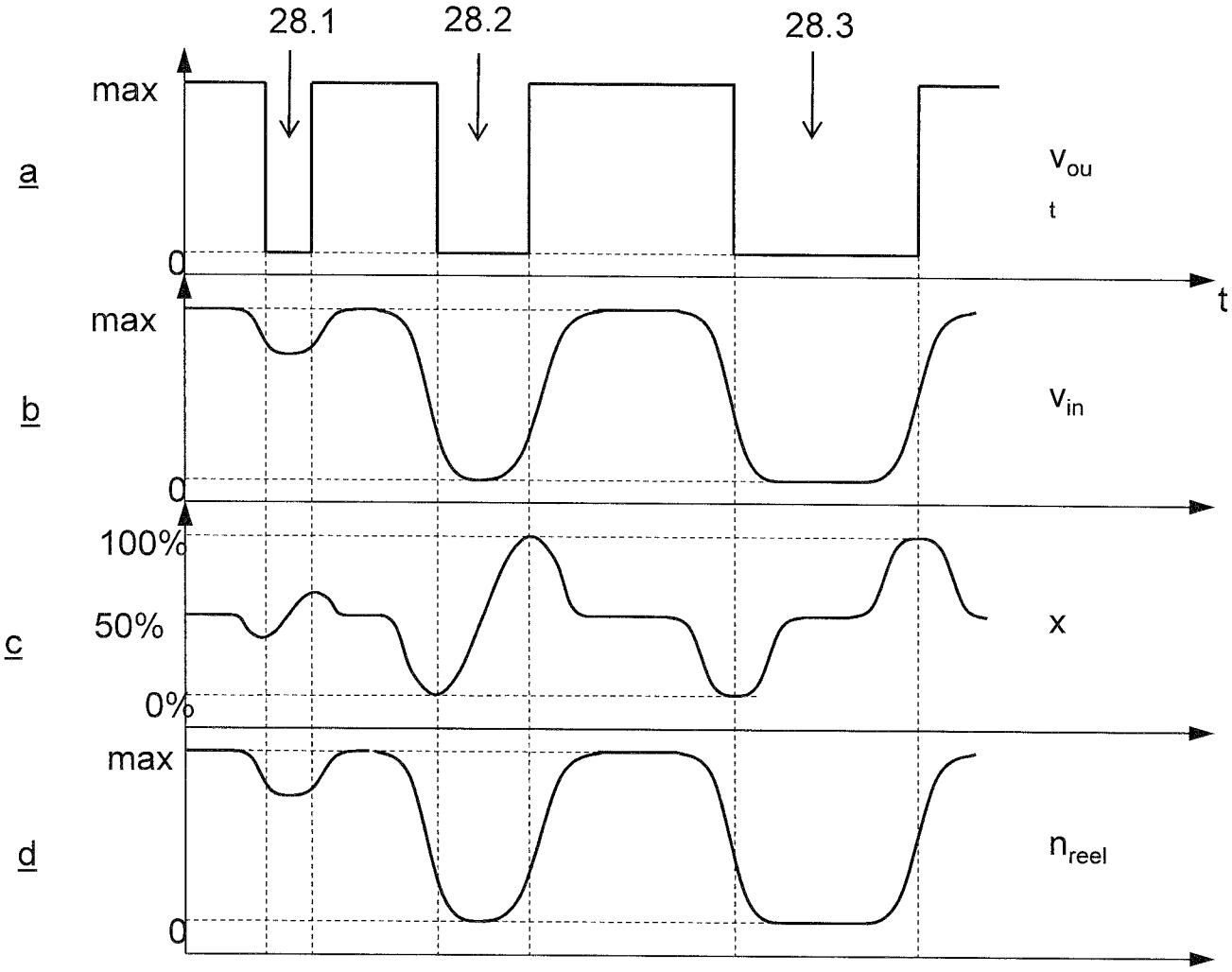

Graphs a-d of FIG. 6 show the temporal sequence of the speeds Vout and Vin, the occupation level x of the strip store 16, and the speed of rotation nreel of the retainer 17 and of the label-strip roll 11*c* respectively during a labeling operation with gaps 28.1-28.3 of differing sizes in the container flow feeding to the container inlet 8.1. The sizes of these gaps, i.e. the number of containers 3 missing rises from the first gap 28.1 to the third gap 28.3. At the beginning of each gap 28.1-28.3, the speed Vout is reduced without temporal delay from the maximum speed to zero, i.e. the provision of labels for transfer to the container is ended abruptly. At the end of each gap 28.1-28.3, also without any temporal delay, the speed Vout is increased from zero to the maximum speed predetermined by the performance of the stretch blow-molding machine. On the basis of the run-up time tv, established by taking account of the information and control signal S from the sensor unit 13, by appropriate actuation of the drive of the label strip feed 14 and of the first drive 25, a reduction of the speed Vin as well as a reduction of the speed nreel are initiated, and specifically at a point of time that in the run-up time tv lies before the point of time at which the start of the gap 28.1-28.3 reaches the labeling position 10.1. Likewise, taking into account of the run-up time tv, the increase in the speed Vin is initiated again at a point of time that in the run-up time tv lies before the point of time at which the first container 3 following a gap 28.1-28.3 reaches the labeling position 8.1. As graphs a and b show, the reduction of the speed Vin is less with a smaller gap 28.1, i.e. for example with a gap of one or two missing containers 3, than with larger gaps 28.2 and 28.3, wherein then, corresponding to graph c in FIG. 6, the reduction in the occupation level x of the strip store 16, already initiated before the occurrence of a gap at the labeling position 10.1, as well as the increase in the occupation level x of the strip store 16, which was already initiated before the end of the gap at the labeling position 10.1, are less with a smaller gap 28.1 than with larger gaps 28.2 and 28.3.

In addition to the components described, the label strip feed 14 and/or the labeling unit 15 comprise further components, such as a device for measuring and/or maintaining a predetermined tension of the label strip 11*a*, 11*b* at least during the labeling operation, etc.

Figure 4:
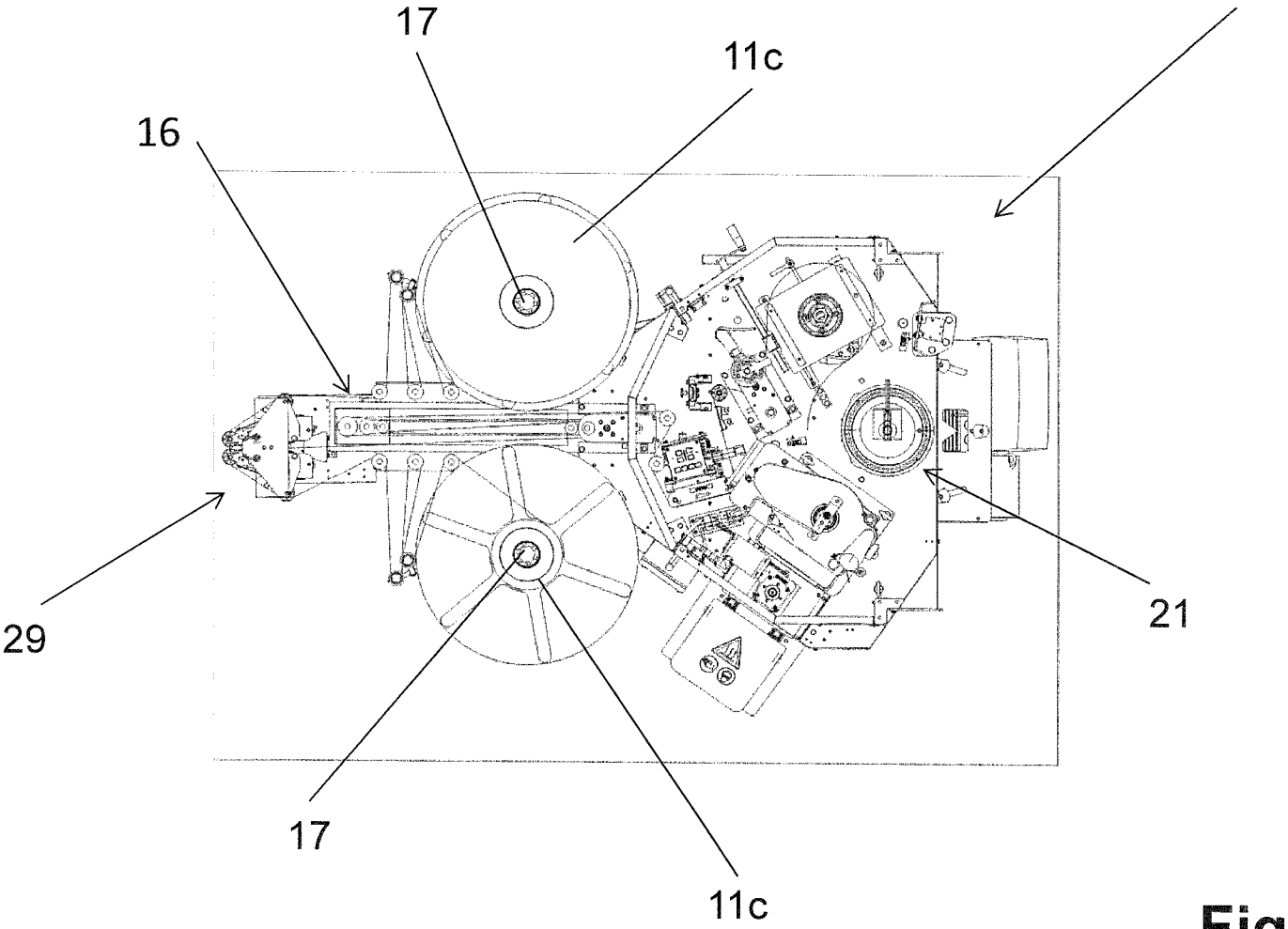
FIG. 4 shows a labeling unit for use with the labeling machine from FIG. 1, with two retainers for the label strip rolls providing the label strip.

With the labeling units used in practice, it is usual for their label strip feeds 14 to be configured with at least two retainers 17, in each case for a label-strip roll 11*c*, as is the case with the labeling machine 10 represented in FIG. 4, configured for the processing of the label strip 11*a*.

During the labeling process, the label strip 11*a* is drawn off from a label-strip roll 11*c* while the other label-strip roll 11*c* is held in reserve or in stand-by. By means of a splicing device 29 provided in the transport direction of the label strip 11*a*, upstream of the strip store 16, it is possible, without interrupting a running labeling process, to connect the end of the labeling strip 11*a* of a used-up label-strip roll 11*c* to the beginning of the label strip 11*a* of the label-strip roll 11*c* in stand-by.

Figure 7:
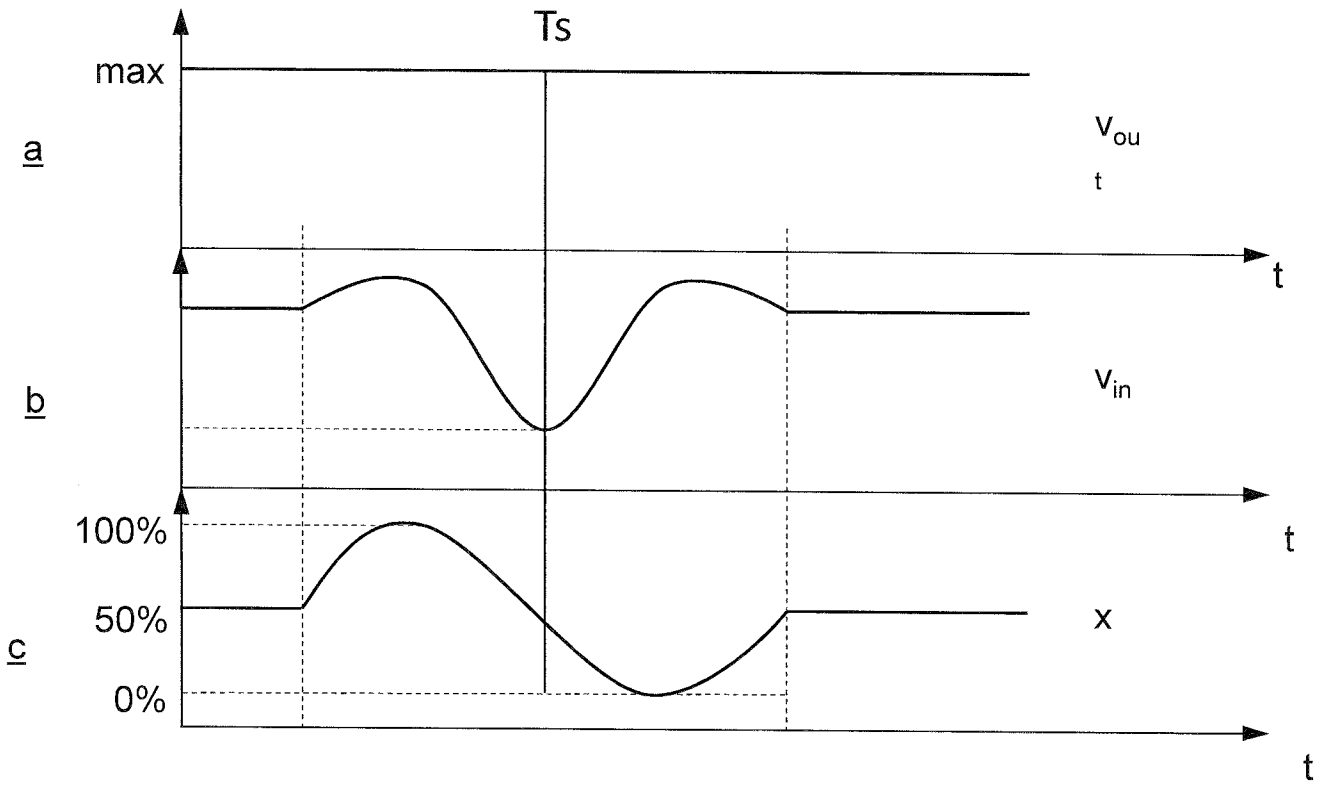

Graphs a-c of FIG. 7 show the temporal sequence of the speeds Vout and Vin, as well as the temporal sequence of the occupation level x of the strip store 16 before and after the point of time TS of the splicing. By means of a control signal preceding the point of time TS and generated, for example, by the control electronics 12, at a constant speed Vout, by the appropriate actuation of the drive of the label strip feed 14 and of the first drive 25, i.e. by increasing only the speed Vin of the label strip 11*a* being used at that moment, an increase in the occupation level x of the strip store 16 is achieved, and, following that, a reduction in the speed Vin of the label strip 11*a* being used at that moment to a reduced value, which allows for the splicing process to take place. After the point of time TS and after the connecting of the label strip 11*a* of the stand-by label-strip roll 11*c* with the label strip 11*a* of the used-up label strip roll, by appropriate actuation of the drive of the label strip feed 14 and of the first drive 25, the speed Vin is again increased, and specifically with reduction of the occupation level x of the strip store 16. The speed Vin is then reduced again to its original value corresponding to the speed Vout.

The method steps described for controlling and/or regulating of the labeling machine 10 and the speeds Vout and Vin, of the occupation level x of the strip store 16, and of the speed of rotation nreel, are possible because the strip store 16 is an active store with the first, second, and third drives 25, 26, 27, and also because of the temporally pre-emptive information and control signal S. Important technical control measures and properties of the labeling machine 10, which are applicable to all embodiment forms of the invention, include:

- Information by means of which the containers 3 fed to the labeling system 8, of which the number, divisional distribution, and/or temporal sequence, are detected and evaluated, wherein this information is provided from the stretch blow-molding machine 2 and/or from the sensor device 13 arranged between this machine and the labeling system 8.
- The movement and actuation of the drives of the label strip feed 14, the labeling unit 15, and of the strip store 16, and in particular, of the first, second, and third drives 25, 26, 27, takes place as a function of this information and its evaluation in such a way that the labeling machine 10 starts with the transfer of the label when, at the beginning of a labeling operation or after the ending of a gap in the container flow, a container 3 is located at the labeling position 10.1, and then stops, without any delay, if there is no container present at the labeling position 10.1.
- The actuation of the drives of the label strip feed 14, the labeling unit 15, and of the strip store 16, in particular also of the first, second, and third drives 25, 26, 27 takes place in such a way that, at least during the labeling operation, the label strip 11*a*, 11*b* respectively present a minimum strip tension.
- At the resumption of the labeling process, the labeling system 8 and its labeling machine 10 are preferably in a start position, at least shortly before a first container 3 reaches the labeling position 10.1, wherein, in this start position, the strip store 16 comprises a middle occupation level x, i.e. the carriage 24 is in a middle position, for example, in a middle setting, a set reference strip tension value is imposed on the labeling strip 11*a*, 11*b* respectively, and tension and/or control information is provide at all the motors of the drives, and in particular, at the first, second, and third drives 25, 26, 27.
- Due to this start position, the start of the labeling machine 10 can be improved, the loads on the machine are reduced, and the first and second label strips 11*a*, 11*b* are not subjected to excessive stress. Time is also gained so that the high-mass function elements or components, including the label-strip rolls 11*c*, can be sped up in time.
- The labeling machine 10 preferably continues to adopt a waiting or rest position, which is then adopted if the production or labeling process has been stopped for an extended period of time. In this situation, the dancer roller or carriage 24 is then in a rest position, for example, in one of the two possible end positions, the strip tension is substantially reduced, or is completely relieved. The motors of the first, second, and third drives 25, 26, 27 are switched off.
- When the labeling machine 10 is moved up to the first container 3 at the beginning of the labeling process and/or after a gap in the containers, and also when the labeling machine 10 is moved up to the last container 3 at the end of the labeling process and/or at the beginning of a gap in the containers, the strip store 16, which is configured as an active store, provides adequate first and second label strip 11*a*, 11*b* respectively for the labeling of the containers 3 at the labeling unit 15 until the components of the label strip feed 14, and in particular the label-strip roll 11*c* located there have been sped up to the required revolution speed, or have been braked respectively, and specifically still before the label transport to a container 3 has begun or has been interrupted.
- Due to the functional interaction of the label strip feed 14, the labeling unit 15, the strip store 16 and their respective drives, it is possible in each case to react to a change in the operational mode of the labeling machine 10 before this operational mode is actually reached, or before the change in the operational mode takes place. Due to the constant exchange of information between the upstream machine, which in the embodiment shown is the stretch blow-molding machine 2, and the sensor unit 13 respectively, clear information is provided at all times as to whether and/or when the next container 3 will reach the labeling position 10.1.
- When the labeling unit is moved into position at the beginning of the labeling process and/or after the ending of a gap in the flow of containers and before the transfer of the label 11 to a first container 3, the label-strip roll 11*c* undergoes initial speeding up, and label strip 11*a*, 11*b* respectively is delivered from the label strip feed 14 into the strip store 16. It is only when the first container 3 has reached the labeling position 10.1 that, by the actuation of the second drive 26 at the labeling unit 15, the transfer is initiated of the label 11 to this container, as well as to the containers following at the division spacing interval. Due to the absence of components with very high moments of inertia, the second drive 26 is capable of speeding up more rapidly than the label strip feed, due to substantial torque moment of the label-strip roll 11*c*, such that, initially, more label strip 11*a*, 11*b* respectively is drawn from the strip store 16 than flows to this store from the label strip feed 14. The occupation level x of the strip store 16 in this situation therefore initially decreases, as is represented in graph c of FIGS. 5 and 6. Then, when both speeds Vout and Vin are equal, a stable state is established, at which the occupation level x remains constant or essentially constant, and corresponds to only a part, for example 50% or approximately 50%, of the maximum capacity of the strip store.

It has been assumed that the labeling machine 10, at the commencement of the labeling process, makes use of the run-up time tv, and in this situation preferably starts from the start position. In principle, however, it is possible that, at the commencement of the labeling process, the labeling machine 10 starts without the use of the run-up time tv, but preferably again from the start position. Independently of this, however, it is possible for the control of the labeling machine 10, in the event of gaps 28.1-28.3 occurring in the flow of containers, to take place in the manner that has been described in connection with FIG. 6.

The invention has been described on the basis of a particular embodiment. It is understood that numerous modifications and deviations are possible, without thereby departing from the basic general conception of the invention.

For example, in an alternative embodiment, the label strip 11*a*, 11*b* is guided, over its length between the retainer 17 and the label-strip roll 11*c* and the strip store 16, also over label strip deflections of a further label strip store, which is, for example, spring-loaded. Likewise, following on in the label strip transport direction onto the strip store 16, further label strip deflections and/or further label strip stores are provided for.

In the foregoing description, a motorized drive moves the strip-store's dancer roller or carriage 24. However, other motive sources are possible. For example, a spring, either by itself or in cooperation with the third drive 27 can be used to move the dancer roller or carriage 24. In such cases, control of the occupation level x of the strip store 16 takes place by the corresponding actuation only of the first label draw-off device 18, which forms a strip-store inlet, and of the second label draw-off device 19, which forms a strip-store outlet.

The labeling machine 10 has been described for the application of labels 11 onto the containers 3. However, the labeling machine 10 can be used in the same way to apply other application elements, such as foils, can be applied onto the containers 3. It is also possible for the labeling system 8 to comprise two or more than two labeling units 10. In such cases, it is preferable for each one to be controlled in the manner described herein.

The invention claimed is:

1. An apparatus comprising a labeling machine for applying labels onto containers in a container flow, said labeling machine comprising a label-strip feed, a retainer, a labeling unit, an active strip-store, a dancer roller, a first controllable drive, a second controllable drive, and a third controllable drive, wherein said labeling unit transfers a label to a container located at a labeling position of said labeling machine, wherein said active strip-store is disposed between said labeling unit and said label-strip feed, wherein said first, second, and third controllable drives are controllable independently of each other, wherein said retainer retains a label-strip roll, wherein said first drive controls operation of said label-strip feed, wherein said second drive controls operation of said labeling unit, and wherein said third drive controls operation of said dancer roller, wherein said labeling machine is a constituent of a block-form container handling system, wherein said active strip-store is configured to transition between a first operating mode and a second operating mode, wherein, in said block-form container handling system, containers are transported via a transport stretch into an container inlet of said labeling system in a container flow that defines a particular spacing interval between containers in said flow, wherein said first operating mode is a labeling mode during which containers present at said labeling position are labeled, wherein said second operating mode is a non-labeling mode in which no container is present at said labeling position, and wherein said active strip-store is configured to transition between said first and second operating modes in response to a control signal that is generated in response to detecting a forthcoming gap in said container flow.

2. The apparatus of claim 1, further comprising a signal source disposed upstream of said labeling machine for providing a signal containing information about container flow upstream of said labeling machine.

3. The apparatus of claim 2, wherein said signal source comprises a container-handling machine disposed upstream of said labeling machine.

4. The apparatus of claim 2, wherein said signal source comprises a sensor disposed on a container-transport stretch that is upstream of said labeling machine.

5. The apparatus of claim 1, wherein said labeling unit is controllable to issue a label when a container is located at said labeling position and to refrain from issuing a label when no container is present at said labeling position.

6. The apparatus of claim 1, wherein at least one of said drives is configured to be activated before a first container following a gap in said container flow has reached said labeling position.

7. The apparatus of claim 1, wherein said strip store has an occupation level, and wherein said occupation level is configured to be increased during a run-up time following resumption of labeling that follows after having detected an end of a gap in said container flow.

8. The apparatus of claim 1, wherein said strip store has an occupation level, and wherein said occupation level is configured to be temporarily decreased during a follow-on period that follows a point of time at which a first container is labeled following a gap in said container flow.

9. The apparatus of claim 1, wherein said strip store has an occupation level, wherein, while running an interruption-free labeling process, said strip store maintains an average occupation level that is 50% of its maximum storage capacity.

10. The apparatus of claim 1, wherein said label-strip feed is configured such that, upon onset of a run-up time before a last container before a gap in said container flow has reached said labeling position, said label-strip feed begins to reduce its speed.

11. The apparatus of claim 1, wherein said label-strip feed is configured such that, during a follow-on period, which follows a point of time at which a last container prior to a gap in said container flow has reached said labeling position, said label-strip feed reduces its speed.

12. The apparatus of claim 1, wherein said strip store has a variable occupation level, wherein said strip store is configured to reduce said occupation level during a run-up interval that is measured from when a last container before a gap in said container flow is expected to reach said labeling station and to increase said occupation level during a follow-on period that is measured from when said last container before said gap in said container flow has reached said labeling station.

13. The apparatus of claim 1, further comprising a container-handling system that, in block form, comprises said labeling machine and a further container-handling machine upstream of said labeling machine along a container-transport direction, wherein said labeling unit is controllable by signal, wherein said signal is selected from the group consisting of a control signal and an information signal, wherein said signal provides information selected from the group consisting of information defining a position of a first container, information defining a position of a last container, information identifying a container-flow gap, information identifying a beginning of a container-flow gap, and information identifying an end of a container-flow gap.

14. The apparatus of claim 13, further comprising a container-transport stretch between said labeling machine and said further container-handling machine, wherein said signal is formed by a sensor unit provided at said container-transport stretch.

15. The apparatus of claim 14, wherein said container-transport stretch extends between said labeling machine and at least one of said sensor and said further container-handling machine, and wherein said labeling machine has a retention capacity of at least ten containers.

16. The apparatus of claim 13, wherein said further container-handling machine has a capacity that can only be adjusted in steps.

17. The apparatus of claim 13, wherein said further container-handling machine comprises a stretch blow molding machine.

18. The apparatus of claim 13, wherein said further container-handling machine has a fixed capacity.

19. The apparatus of claim 13, further comprising a container-transport stretch between said labeling machine and said further container-handling machine, wherein said signal is formed by said further container-handling machine.

* * * * *